United States Patent [19]

Varda

[11] 4,236,458

[45] Dec. 2, 1980

[54] DOOR LOCKING AND ACTUATING MECHANISM FOR HOPPER CAR

[75] Inventor: Eugene I. Varda, Saint John, Ind.

[73] Assignee: Pullman Incorporated, Chicago, Ill.

[21] Appl. No.: 972,858

[22] Filed: Dec. 26, 1978

[51] Int. Cl.[3] ..... B61D 3/00; B61D 7/00; B61D 9/00

[52] U.S. Cl. ..... 105/308 R; 105/247; 105/280; 105/286

[58] Field of Search ..... 105/241, 239, 240, 247, 105/308 R, 280, 286, 288

[56] References Cited

U.S. PATENT DOCUMENTS

| | | | |
|---|---|---|---|
| 905,569 | 12/1908 | Orenstein | 105/241 R |
| 941,405 | 11/1909 | Carr . | |
| 1,909,341 | 5/1933 | Galanot . | |
| 3,361,478 | 1/1968 | Ross, Jr. et al. | 298/35 |
| 3,403,636 | 10/1968 | Andrews | 105/241 R |
| 3,886,846 | 5/1975 | Chang et al. | 132/306 |

*Primary Examiner*—Richard A. Bertsch
*Attorney, Agent, or Firm*—Richard J. Myers

[57] ABSTRACT

A locking and actuating mechanism for a pair of horizontally movable hopper doors includes an arm and actuating linkage which engages a track side cam for moving the doors between open and closed positions. One of the doors includes a keeper which is engageable by a latch mechanism in the other door. The latch mechanism includes a linkage arrangement which is connected to the actuating link and arm by means of a lost motion connection.

20 Claims, 8 Drawing Figures

22
28
31
71
70
78
76
77
73
75
74
67
33
72
68
69
65
66
38
62
39
47
32'
64
61
60
59
35
46
48
37
57
36
44
42
45
43
34
32

23
82
81
79
80
83
30
29
40
41

DOOR LOCKING AND ACTUATING MECHANISM FOR HOPPER CAR

BACKGROUND OF THE INVENTION

1. Field of the Invention

The invention broadly relates to railway hopper cars. More specifically it relates to the door locking and actuating mechanism for an open top hopper car including lower discharge openings and clam shell type doors laterally movable outwardly to an open position.

2. Description of the Prior Art

The prior art is exemplified by U.S. Pat. No. 3,361,478, which illustrates a bottom dump trailer structure, and U.S. Pat. No. 3,885,846, which shows a double action mechanism for adjustably supporting a shelf within an enclosure. The present invention improves upon these designs by providing a novel arrangement for operating and locking clam shell type discharge doors of a railway hopper car.

SUMMARY OF THE INVENTION

The construction of the present invention relates to hopper cars of the open type having a central lower discharge opening construction which is regulated by two pairs of longitudinally spaced clam shell type doors which are hingedly connected to the hopper structure for movement substantially laterally and horizontally outwardly to the open position. Actuating means for moving the doors to the open position include arms hingedly connected to the hopper structure which are provided at lower ends with cam followers adapted to be engaged by track side cams for moving the arms to an open position. Each of the arms is connected to an actuating link which in turn is pivotally connected to each door. Upon movement of the arm and actuating link when the cam follower of each arm engages the track side cams provided, the door is moved outwardly to an open position.

The doors of the present invention are provided with inner longitudinal engaging or mating edges providing an effective sealing arrangement when the doors are in their closed position. One of the doors at longitudinally opposite ends thereof is provided with keeper members having latch receiving sockets which are positioned in relative overlapping relation with respect to the ends of the adjacent mating door. The latter door includes a locking mechanism comprising latch members which are longitudinally movable to engage the keeper sockets for maintaining the doors in the closed position. Each latch mechanism includes a biasing arrangement normally urging the latch members into the closed or socket-engaging position with relation to the keeper members. The latch members are pivotedly connected to first tension rods or links, in turn operatively connected to bell cranks which in turn are pivotedly connected to a laterally extending, second tension rod or link, in turn connected to the actuating link and arm arrangement. The connection provided for this purpose includes a hinged plate element which is pivotedly connected to one end of the actuating link. Another end of the hinged plate is pivotedly connected to the laterally extending, second tension rod or link. The outer edge of the door containing the locking linkage is provided with outwardly projecting brackets which support a fixed, longitudinally extending pin. The hinged plate, which is pivotally supported by the brackets on the door and is pivotally connected to the actuating link, also includes a lost-motion connection or slot through which the fixed pin extends. As the cam follower of each arm engages the side of track cam mechanism the arm is pivoted slightly outwardly in turn causing the actuating link to pivot the hinge plate, this initial movement causing the plate to move outwardly by virtue of the lost motion connection until it is restrained for further outward movement by the fixed pin connected to the outwardly projecting brackets on the outer portion of the door. During this movement of the hinged plate the first and second tension links are actuated to pull on the latch member, thereby disengaging the same from the sockets of the keeper members, whereupon the doors are now moved outwardly to a discharge position.

DESCRIPTION OF THE PREFERRED EMBODIMENT

Figure 1:
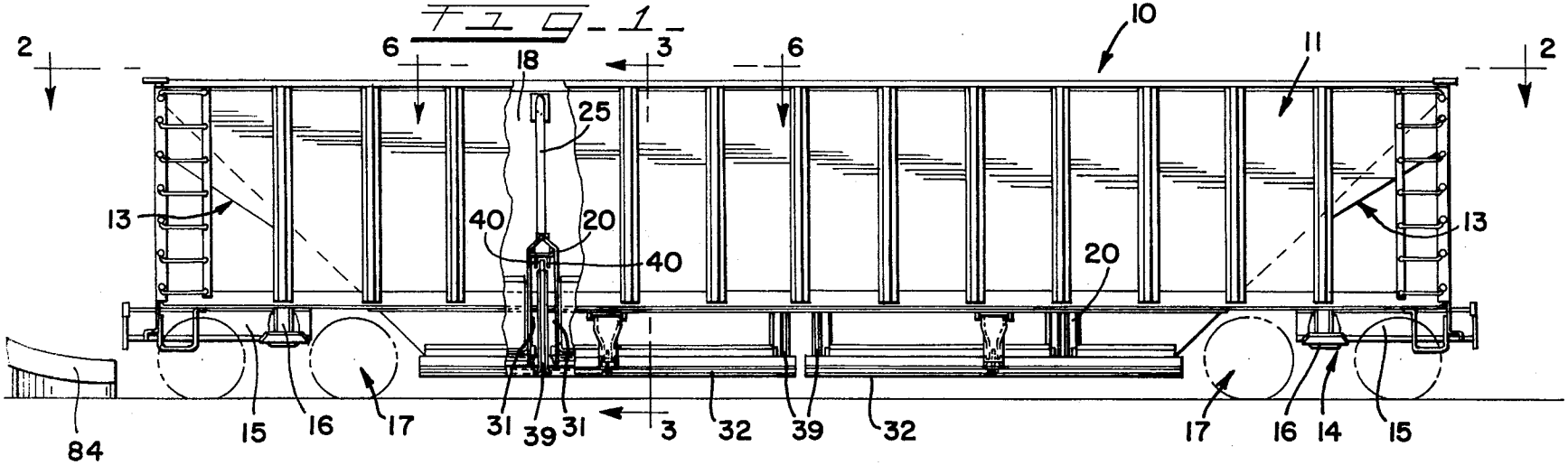
FIG. 1 is a side elevational view of a railway hopper car having certain portions broken away to show the interior divider arrangement.
Figure 2:
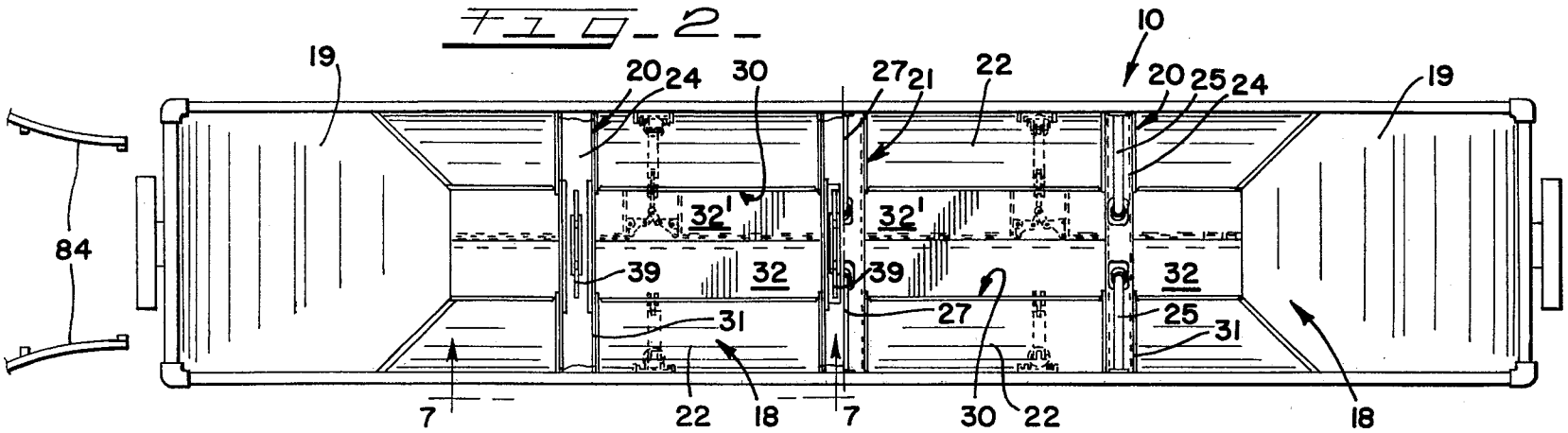
FIG. 2 is a plan view of the railway car shown in FIG. 1.
Figure 3:
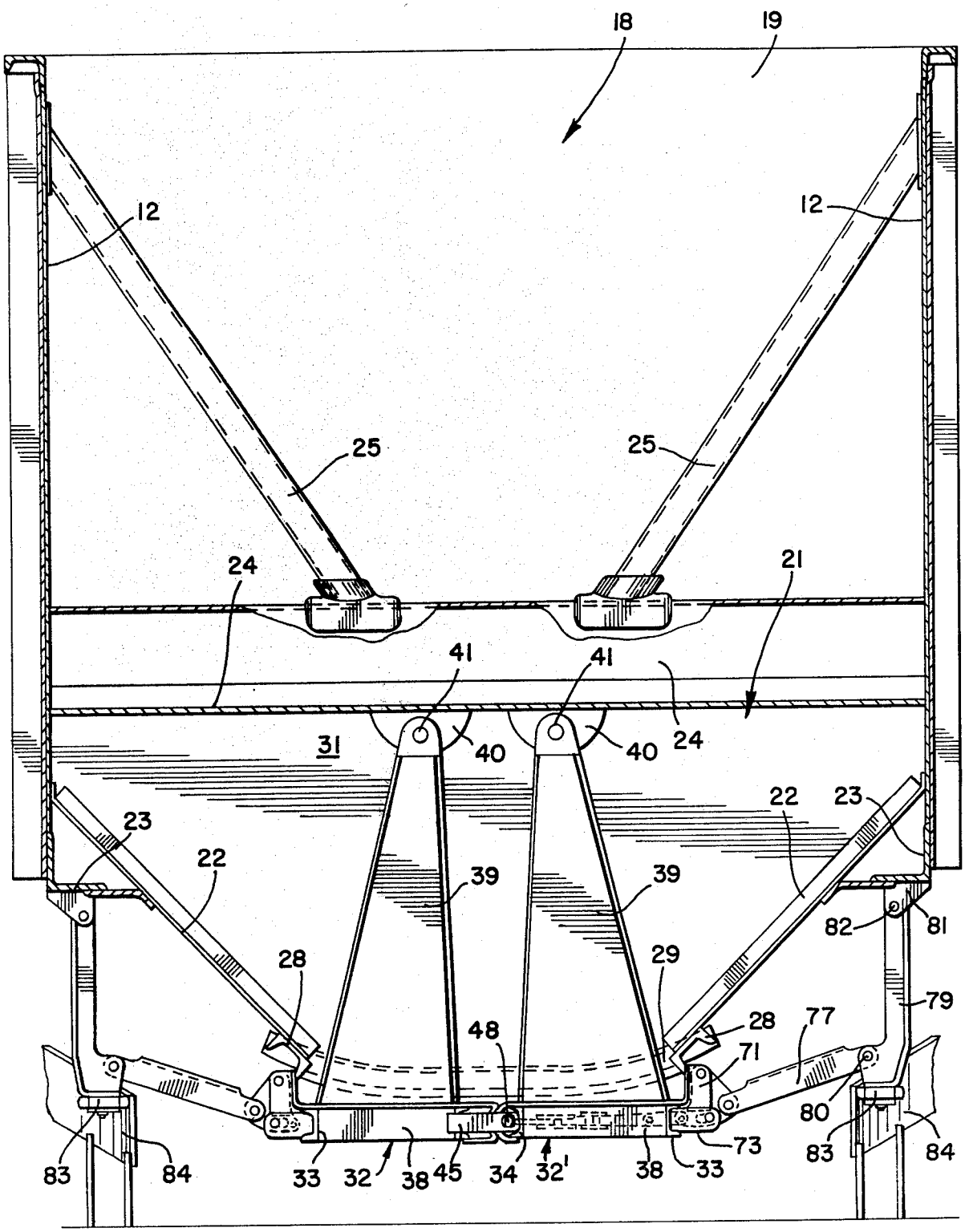
FIG. 3 is a cross-sectional view taken substantially along the line 3—3 of FIG. 1.
Figures 4, 5:
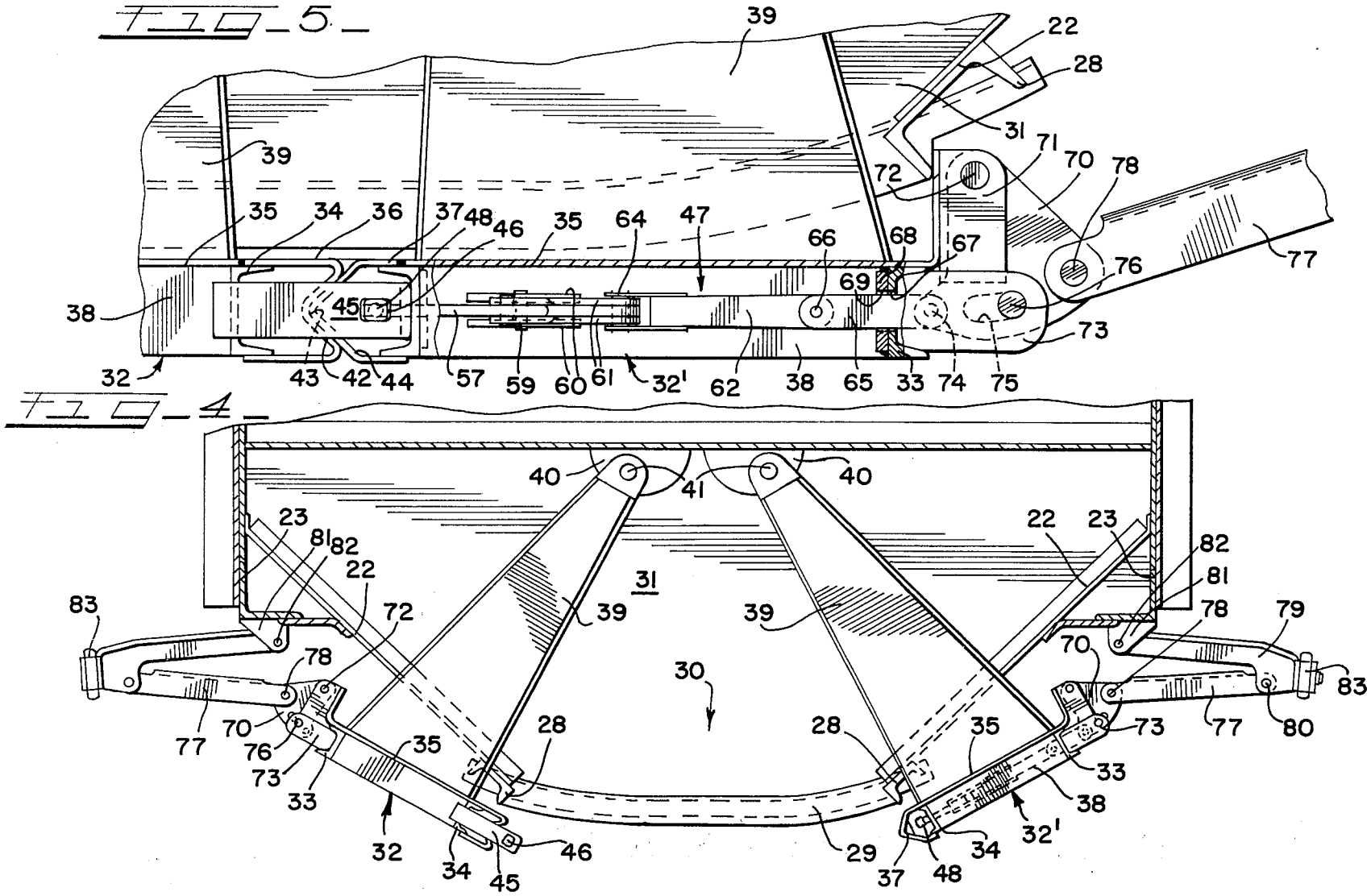
FIG. 4 is a view similar to FIG. 3 showing the lower portion of the car and clam shell type doors in an open position.
FIG. 5 is a cross-sectional view taken substantially along the line 5—5 of FIG. 6.

FIGS. 1 and 2 disclose a hopper car 10 of the open type which includes a car body 11, car sides 12 and end walls 13. The body 11 is supported on an underframe 14 which includes a pair of end stub sills 15 having bolster 16 suitably supported on wheel trucks 17 in conventional fashion. The present hopper car 10 is of the coal carrying type which includes a pair of longitudinally spaced hopper structures 18 each of which includes an end slope sheet 19 and side slope sheets 22. Each of the hopper structures 18 are provided with divider well housings 20 and are separated by a central well housing 21. The car body 11 includes as best shown in FIGS. 3 and 4 longitudinally extending side sills 23 which provide support for the slope sheets 22. As best indicated in FIGS. 2 and 3 the wells 20 include transverse housing members 24 supporting diagonal braces 25 which project upwardly and are suitably connected to the sides 12 for reinforcing the same.

Figure 7:
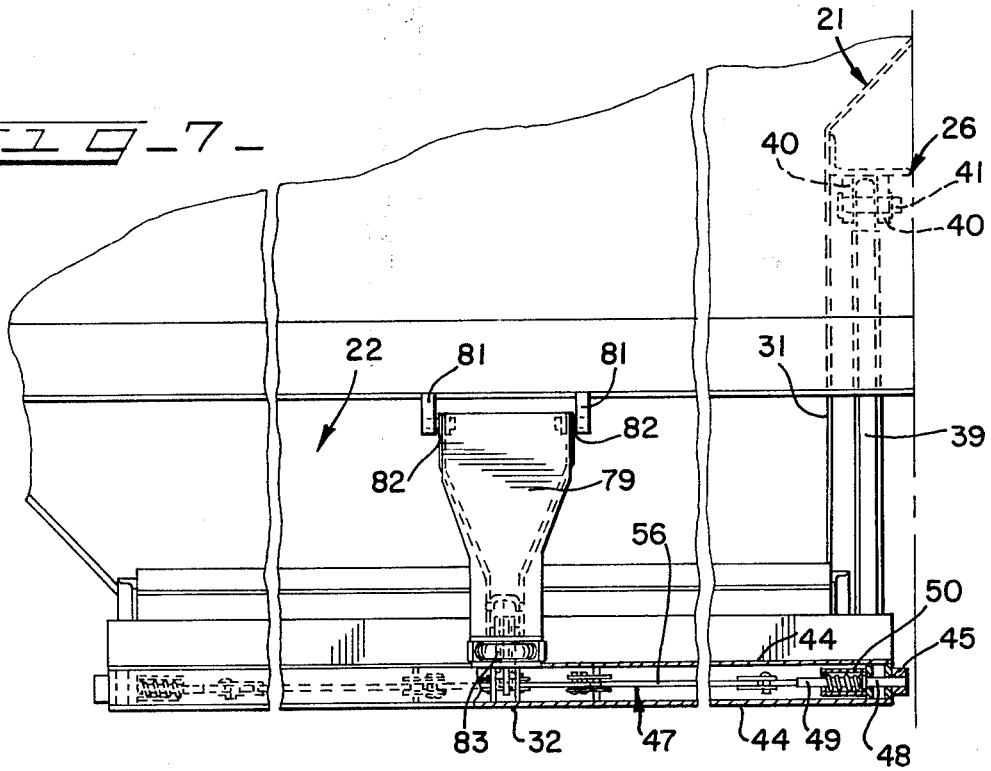
FIG. 7 is a side elevational view taken substantially along the line 7—7 of FIG. 2.

As best shown in FIG. 7 the central well 21 also includes a transverse housing member 26 which support diagonal braces 27 also projecting upwardly and being suitably connected to the sides of the car body, as shown in FIG. 2.

As best shown in FIGS. 3 and 4, the lower ends of the side slope sheets 22 have connected thereto longitudinal channel reinforcements 28 connected at opposite ends to transversely extending end reinforcing bars 29. Reinforcements 28 and bars 29 define discharge openings generally indicated at 30 through which material may be discharged from the hopper structures.

Referring now particularly to FIGS. 4 and 5 a pair of doors 32 and 32' are provided for each of the hopper structures 18. Each of the doors 32 and 32' includes longitudinal channels 33 and 34 suitably connected by means of a top plate structure 35. The door 32 is provided at its inner end with a longitudinally extending generally U-shaped channel 36 and a door 32' is provided with a longitudinally extending generally V-shaped channel 37. Each of the doors also includes a plurality of laterally extending walls or transverse supports 38. The doors 32 and 32' are hingedly connected to the hopper structure by means of hanger members 39 pivotedly supported on hinge brackets 40 by means of hinge pins 41, the brackets 40 projecting downwardly from each of the transverse housing members 24 as best shown in FIG. 1. As best shown in FIG. 7, the transverse housing members 26 also includes the brackets 40 for supporting the ends of the doors on the hanger members 39.

As shown in FIGS. 1 and 7, vertical hopper walls 31 also form end portions of the hoppers adjacent to the housing 20 and 21.

Figure 6:
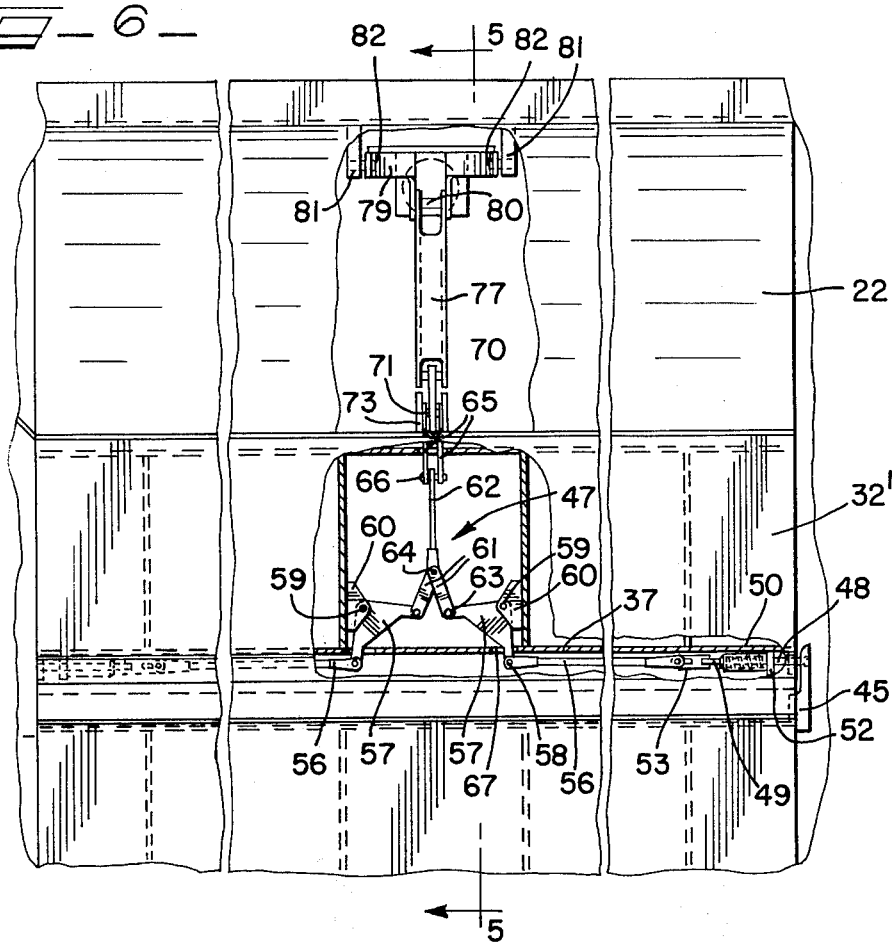
FIG. 6 is a plan view with portions of the door and hopper structure broken away, the same being taken substantially along the line 6—6 of FIG. 1.
Figure 8:
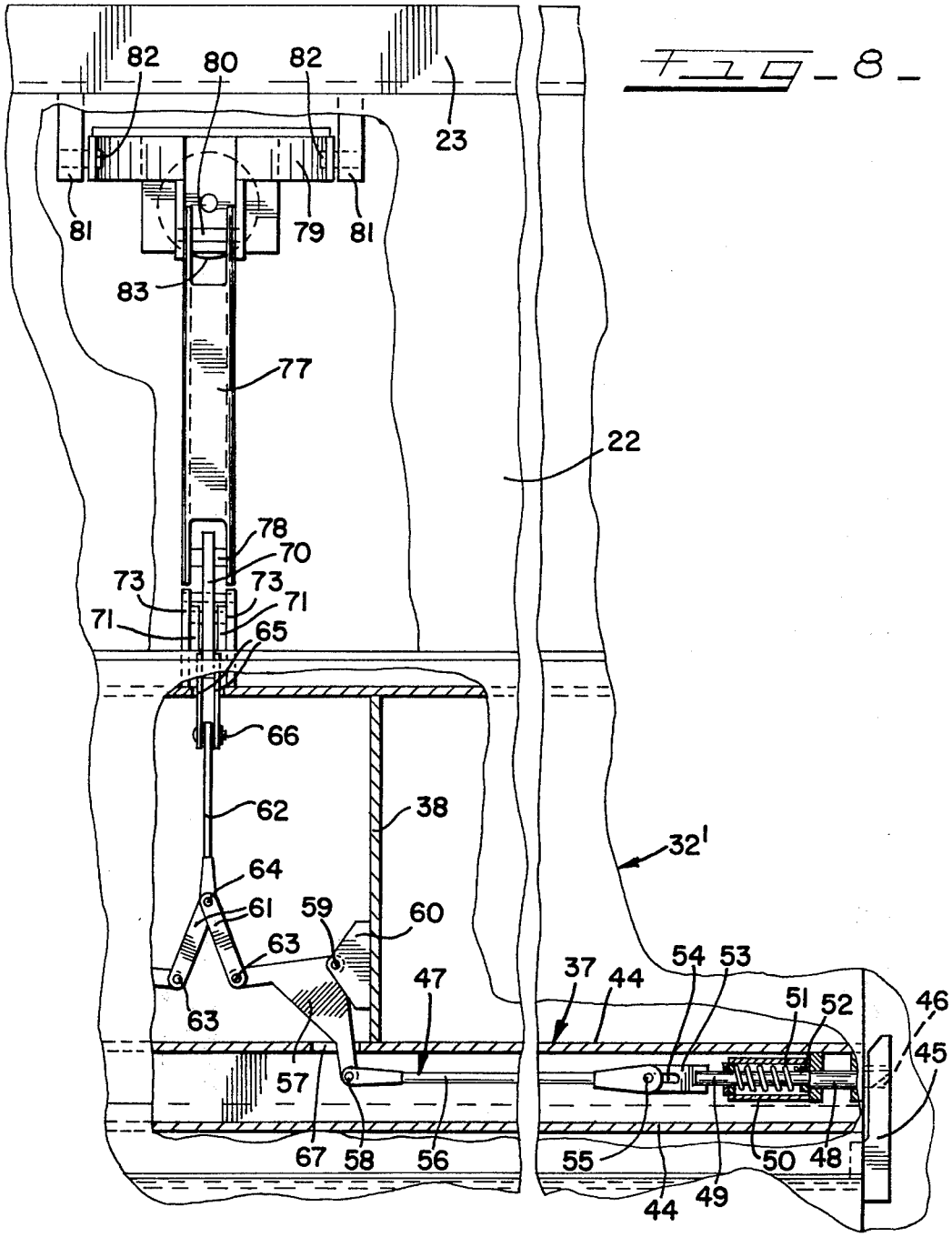
FIG. 8 is an enlarged view similar to FIG. 6 disclosing in detail the linkage and locking arrangement for one of the hopper car doors.

Referring now particularly to FIG. 5, the U-shaped longitudinal channel 36 provided for the door 32 includes inwardly diverging, longitudinally extending walls 42 providing a longitudinal groove designated at 43. The V-shaped channel 37 for the door 32' includes outwardly converging, V-shaped walls 44 which, as best shown in this view, engage the longitudinal groove 43 in registering or nesting relation providing an excellent seal for the adjacent closed doors. Opposite ends of the doors 32 are provided with keeper members 45 which, as best shown in FIG. 5, overlap the door 32'. Each of the keeper members includes a keeper socket 46. Referring particularly to FIGS. 5, 6 and 8, a locking mechanism 47 includes a pair of latch members 48 positioned at opposite, longitudinal ends of the door 32'. Each of the latch members 48 is connected to a rod 49 extending in sliding relation through a housing 50. The housing 50 includes a spring arrangement 51 held captive therein and engaging a collar 52 fixedly connected to the rod 49 for urging the same outwardly to the closed position wherein the end of the latch member 48 is in locking relation with respect to the keeper socket 46 as best shown in FIG. 8. A plate 53 is connected to each of the rods 49 and is provided with a slotted connection 54 which is engaged in sliding relation by means of a pivot pin 55 connected to a first tension rod or link 56. The first tension rod 56 is connected by means of a hinge pivot 58 to a bell crank 57, in turn hingedly connected by pivot means 59 to upper and lower brackets 60 suitably supported on one of the laterally extending walls 38 provided in each of the doors. As best shown in FIG. 8, the V-shaped channel 37 of the door 32' also includes an opening 67 to accommodate the pivotal movement of the bell crank lever 57. The bell crank lever 57 also is pivotally connected to link 61 by means of pivot connection 63, and a pivot 64 connects the links 61 to a second tension rod 62. The tension rod 62, as best shown in FIGS. 5 and 8, is pivotally connected to links 65 by means of a pivot 66. Referring now to FIG. 5, the channel 33 at the outer end of the door 32' is provided with an opening 37 to accommodate the movement of the links 65 and inner plate 68 includes an opening 69 registering with the opening 67, said plate providing reinforcement of the channel 33.

As best shown in FIG. 5, each of the doors 32 and 32' includes hinged vertical plate members 70 suitably supported for hinging movement by means of hinge pins 72 on brackets 71 which are connected to the outer channels 33 of the doors 32 and 32'. On opposite longitudinally spaced sides of the plates 70 the channel members 33 are provided with outwardly projecting ears or brackets 73. The outer ends of the links 65 are connected by means of a pin 74 to each of the hinge plates 70. Each of the hinge plates 70 also includes a slot 75 which accommodates the transversely extending fixed pin 76 supported on the ears 73. The pin 76 limits the hinged movement of the hinge plate 70 thereby providing a lost motion connection.

Referring particularly to FIGS. 4 and 5 an actuating link is designated at 77 and is hingedly connected to each of the hinge plates 70 by means of hinge pins 78. An arm 79 is hingedly connected to the actuating link 77 by means of a pin 80. As best shown in FIGS. 4 and 8, brackets 81 are supported on the side sill 23 and in turn hingedly support the ends of the arms 79 by means of hinge pins 82. Each of the arms 79 is provided at its outer end with a cam follower or wheel 83 adapted to be engaged by opening cams 84, as best shown in FIGS. 1, 2 and 3. Thus each of the doors 32 and 32' is provided with the actuating link 77, arm 79, and associated structure.

THE OPERATION

FIGS. 3 and 5 disclose the doors 32 and 32' in the closed position. In the closed position, as shown in FIG. 5 the outer edges of the doors and particularly the longitudinal channels 36 and 37 are disclosed in nesting relation firmly and effectively sealing the doors in the closed position. FIGS. 6 and 8 also disclose the locking mechanism and the latch members in the closed and locked position. As the car moves along the track and arrives at its destination whereupon the material within the car is to be dumped through the track into a suitable bin, the track side cams 84, as best shown in FIG. 3 are engaged by the cam followers 83, whereupon the arms 79 are moved outwardly. The initial outward movement of the arm 79 causes the arm 77 to move outwardly thereby pivoting the plate 70 to the position wherein the in board end of the slot 75 is up against the rigid slide pin 76. This initial movement provides for the tension link 62 to move outwardly thereby pivoting the bell crank lever 57, as shown in FIG. 8, to move in a clockwise direction placing tension on the tension link 56 thereby pulling the rod 49 and latch mechanism 48 to the left and out of engagement with respect to the keeper 45. In other words, the pivoting movement of the bell cranks 57 in response to the movement of the tension link 62 provides for disengagement of both of the latch members at the opposite ends of the door from the sockets 46, whereupon the door is now free to move to its open position. Thus upon further movement of the arms 79 to the position shown in FIG. 4 the doors are then completely opened to either side underneath the slope sheets 22 and the discharge opening 30 is now completely open for the discharge of material therethrough. After the cam followers leave the cams 84 the slots 54 and the plates 53 permit the spring mechanism 51 to again place the latch elements 40 in a position ready for locking engagement with the keeper members 45 when the doors are again closed. Thus the spring elements again set the bell crank levers 57 in the proper position so that the locking mechanism within the doors can again be effective when the doors are moved to the closed position. The doors are now free to move from the position shown in FIG. 4, after the load has been dumped, to the closed position. The car may then pass through another off-track device, not shown, which applies a force, to the outside of the cam follower on the arms 79, causing the doors to come together and thus providing for engagement of the latch members 48 with the keeper members 45.

What is claimed is:

1. A railway hopper car having an underframe,
a hopper structure supported on said underframe,
walls on said hopper structure defining at their lower ends a discharge opening,
a pair of doors pivotably connected to said hopper structure for outward movement from a closed position below said discharge opening to an open position, the improvement of a door actuating and locking arrangement comprising:
a pair of arms each pivotally connected to said car on opposite sides of said discharge opening,
each of said arms including a cam follower supported thereon,
a pair of actuating links each pivotally connected to one of said arms and to one of said doors,
each of said doors having inner longitudinal nose portions sealingly engaging each other in the closed position of said doors,
a locking mechanism including keeper means mounted on one end of one of said doors and overlapping an end of said other door,
a latch member slidingly mounted on said other door,
means biasing said latch member into locking engagement with said keeper means in the closed position of said doors, and
said latch member operatively connected with said actuating link whereby during engagement of said cam with an associated door opening mechanism, said arm and actuating link are pivoted outwardly and said latch member and keeper means are disengaged whereby said doors are moved to said open position.

2. The invention in accordance with claim 1,
the nose portion of said one door including inwardly sloping longitudinal groove portions, and
the nose portion of the other door including outwardly converging longitudinal wall portions engaging said groove portions in nesting relation.

3. The invention in accordance with claim 1,
said actuating link being connected to said doors by lost motion connecting means.

4. The invention in accordance with claim 3,
said lost motion connecting means including a plate pivotally connected to said other door,
means pivotally connecting said plate to said actuating link,
said plate having an elongated slot, and
pivot means on said door engaging said slot.

5. The invention in accordance with claim 4,
said pivot means including a bracket connected to and projecting outwardly from said other door, and
a pivot pin on said bracket slidingly engaging said elongated slot.

6. The invention in accordance with claim 1,
other second linkage means including a first tension link means pivotally connected to said latch member,
a bell crank lever pivotally connected to said second door,
means pivotally connecting said bell crank lever at one end to said first tension link,
a second tension link extending laterally with respect to said first tension link,
means pivotally connecting said second tension link to the other end of said bell crank lever, and
means pivotally connecting said second tension link to said actuating link.

7. The invention in accordance with claim 6,
said means pivotally connecting said second tension link to said actuating link including a lost motion connection.

8. The invention in accordance with claim 7,
said latch member including means biasing said latch member into locking engagement with said keeper member.

9. The invention in accordance with claim 8,
said latch member including lost motion connecting means connecting said first tension link means to said latch member.

10. The invention in accordance with claim 6,
said means pivotally connecting said actuating link to said second tension link including,
bracket means mounted on said other door,
a vertical plate hingedly supported on said bracket means, and
means pivotally connecting said vertical plate to said actuating link and to said second tension link.

11. The invention in accordance with claim 10, including
second bracket means mounted on said other door and projecting outwardly with respect thereto, and
a pivot pin means mounted on said second bracket means, said vertical plate having an elongated slot engaging said pivot pin means in relative sliding relation.

12. The invention in accordance with claim 11,
said means connecting said vertical plate to said second tension link including a connector linkage.

13. A railway hopper car having a hopper structure including a discharge opening at its lower end, a pair of doors pivotally connected with said hopper structure for movement from a closed position below said discharge opening to an open position away from said discharge opening, the improvement of a door actuating and locking arrangement comprising:
arm means pivotally connected to opposite sides of said hopper car and to each of said doors,
a locking mechanism carried by said doors including a latch means movably mounted on one of said doors and a keeper means mounted on the other of said doors adapted to be engaged by said latch means in the closed position of said doors, and
said latch means operatively connected with said arm means, whereby pivoted movement of said arm means by an associated door opening mechanism disengages said latch means and said keeper means and moves said doors to said open position.

14. The invention in accordance with claim 13, wherein,
said arm means include an arm on each side of said car having one end pivotally connected to said car, and
said arm means further including an actuating link on each side of said car pivotally connected with the other end of said arm and being pivotally connected to a respective door.

15. The invention in accordance with claim 14, and one of said actuating links being operatively connected to said latch means.

16. The invention in accordance with claim 15, said actuating links being connected to said doors by lost motion connecting means whereby initial movement of said arms by an associated door opening mechanism disengages said latch means from said keeper means and further movement of said arms moves said doors to the open position.

17. The invention in accordance with claim 13, and each of said doors having inner longitudinal nose portions sealingly engaging each other in the closed position of said doors.

18. The invention in accordance with claim 13, and said latch means including means biasing said latch means into locking engagement with said keeper member.

19. The invention in accordance with claim 13, said latch means include a pair of latch members each movably mounted on opposite longitudinal ends of said one of said doors, and each of said latch members being operatively connected to said arm means whereby initial pivotal movement of said arm means moves said latch members from a locked position to an unlocked position.

20. The invention in accordance with claim 19, said latch means further including a first tension rod operatively connected to each of said latch members, a pair of bell crank levers pivotally mounted on said one of said doors, each bell crank lever pivotally connected to a respective first tension rod, and a second tension rod operatively connecting said bell crank levers and said arm means.

* * * * *